United States Patent [19]

Shih et al.

[11] 4,142,539

[45] Mar. 6, 1979

[54] SANITIZER ALERT SYSTEM

[75] Inventors: Kelvin Shih; Makram N. Bishai, both of Troy, Ohio

[73] Assignee: Hobart Corporation, Troy, Ohio

[21] Appl. No.: 835,198

[22] Filed: Sep. 21, 1977

[51] Int. Cl.[2] ..... B08B 3/00; B08B 13/00

[52] U.S. Cl. ..... 134/113; 134/25 A; 134/26; 222/39; 422/119

[58] Field of Search ..... 21/103, 104, 107; 134/25 A, 26, 56 D, 57 D, 113; 222/23, 39

[56] References Cited

U.S. PATENT DOCUMENTS

| | | | |
|---|---|---|---|
| 2,500,042 | 3/1950 | Nutting | 134/57 D X |
| 2,592,884 | 4/1952 | Fox et al. | 21/107 |
| 2,592,885 | 4/1952 | Fox et al. | 134/36 |
| 2,592,886 | 4/1952 | Fox et al. | 21/107 |
| 2,626,620 | 1/1953 | Smith | 134/57 |
| 2,740,415 | 4/1956 | Federighi et al. | 134/58 |
| 2,859,760 | 11/1958 | Borell | 134/57 D X |
| 3,000,385 | 9/1961 | Shay | 134/57 |
| 3,044,092 | 7/1962 | Fox et al. | 15/75 |
| 3,134,070 | 5/1964 | Meyer | 324/30 |
| 3,139,890 | 7/1964 | Moran | 134/100 |
| 3,144,029 | 8/1964 | Strandberg | 134/57 |
| 3,146,718 | 9/1964 | Fox et al. | 103/38 |
| 3,319,637 | 5/1967 | Gore et al. | 134/57 |
| 3,370,597 | 2/1968 | Fox | 134/58 |
| 3,376,877 | 4/1968 | Fegan | 134/57 |
| 3,518,174 | 6/1970 | Inoue | 204/149 |
| 3,595,252 | 7/1971 | Conte | 134/109 |
| 3,796,925 | 3/1974 | Breeding | 134/57 D X |
| 3,896,827 | 7/1975 | Robinson | 134/25 A X |
| 3,973,572 | 8/1976 | Brous | 134/57 R |
| 4,036,404 | 7/1977 | Robinson | 222/30 |

*Primary Examiner*—Barry S. Richman

[57] ABSTRACT

Delivery of a chemical sanitizing agent to the rinse system of a warewasher is confirmed by first sensing the absence and subsequently the presence of the sanitizing agent near the outlet of the delivery conduit. Failure to meet these two conditions in this order and within a preset time triggers an alarm to indicate delivery failure.

8 Claims, 3 Drawing Figures

SANITIZER ALERT SYSTEM

BACKGROUND OF THE INVENTION

The present invention relates to warewashers such as dishwashing machines, and more particularly to warewashers in which the food ware items are sanitized chemically rather than thermally.

Prior art warewashers employing chemical sanitization are well-known in the art. A recent example of such a machine is shown in U.S. application Ser. No. 835,197, filed Sept. 21, 1977, assigned to the assignee of the present invention. Earlier examples of such machines may be found in U.S. Pat. Nos. 2,592,884, 2,592,885, 2,592,886, 3,044,092, 3,146,718, and 3,370,597, all assigned to the assignee of the present invention. Such machines potentially provide significant energy economies since they can satisfy sanitization standards by destroying bacteria with relatively low-temperature (approximately 120°-140° F.) chemically sanitizing rinse solutions, rather than requiring high temperature rinse water at 180°-195° F. Although the potential energy savings of chemical sanitization is significant, the design of systems which can both clean acceptably, and also reliably and consistently mix the sanitizing agent into the rinse water in the proper concentration, to assure both consistent and effective cleaning and sanitizing of the food ware items within the warewasher, has proved difficult.

The above-noted U.S. application Ser. No. 835,197, discloses a machine which provides excellent washability and also has a durable and consistently reliable mechanical delivery system for the sanitizer, assuring satisfactory operation even in highly demanding commercial applications. Even a reliable mechanical system, however, may not provide a comfortable assurance that the food ware items are being properly sanitized. That is, sooner or later the supply of the sanitizing agent will be exhausted. At that time, even though the mechanical operation of the warewasher is correct, proper sanitizing depends upon replacement of the chemical sanitizing agent. It is therefore desirable to alert the machine operator when replacement is necessary.

It is also an unavoidable fact that even the best of systems may fail. For example, a pinch in the sanitizer supply tubing (which is often exposed outside the warewasher), or some other obstruction, might impede flow of the sanitizing agent even though the supply bottle was full. It is therefore desirable to do more than simply indicate that the supply of sanitizing agent is exhausted. Preferably, an indication should be provided upon failure of proper delivery of the sanitizing agent. Then, if the warewasher is mechanically reliable, it can be assumed within acceptable design limits that proper delivery of the sanitizing agent to the warewasher is equivalent to proper sanitizing of the food ware items which are being washed.

Of course, detectors for indicating the presence, absence, or quantity of fluid within a container are well-known. Similarly, the prior art shows many flow detectors. As indicated, however, the former, while relatively inexpensive, would not really indicate or test for delivery of the sanitizer. The latter could be inserted in the sanitizer delivery conduit, but generally require sophisticated and expensive components. A need thus remains for an uncomplicated, inexpensive method and apparatus for monitoring and verifying delivery of the liquid chemical sanitizing agent to the warewasher rinse system.

SUMMARY OF THE INVENTION

Briefly, the present invention provides a sanitizer alert system for monitoring and verifying delivery of a liquid chemical sanitizing agent to the rinse system of a warewasher. The sanitizer alert system is activated during each period in the warewasher cycle in which the liquid chemical sanitizing agent is delivered from the supply thereof to the warewasher. Thus, during operation of typical commercial dishwashers, successive racks of dishes will be washed, rinsed, and sanitized, resulting in successive sanitizer delivery periods, one for each rack. The term "rinse system" is meant to apply to whatever portions of the warewasher provide the spray having the chemical sanitizing agent therein, and thus includes warewashers in which the rinse system is dedicated (i.e., separate from the wash water recirculating and spraying system) and integrated (i.e., where the wash and rinse are circulated by the same recirculating pump and spray arms).

In the preferred embodiment, the source or supply of the chemical sanitizing agent is a bottle containing a 5.2% solution of sodium hypochlorite, located at the bottom of the warewasher. A conduit connects the bottle of NaOCl to an air powered venturi aspirator at the top of the warewasher, which draws the NaOCl solution from the bottle and delivers it to the warewasher rinse system. Other pumps besides an air driven venturi aspirator may be used for delivering the NaOCl, but the preferred pump is an aspirator such as shown in U.S. application Ser. No. 835,197, filed Sept. 21, 1977.

Included in the conduit, preferably near the outlet end and just short or upstream of the aspirator, at the top of the warewasher, is a pair of electrodes spaced a short distance (such as 3 inches) from one another. Since sanitizing agents are normally corrosive, the electrodes are titanium probes, which are not attacked by the sanitizer. One of the probes is grounded and the other is connected to a conventional electronic liquid level detector which provides one level of output when the circuit is open (i.e., when no sanitizing agent completes the circuit between the probes) and another output when the circuit is closed (i.e., when the circuit through the probes is completed by the sanitizing agent within the conduit). This thus serves as a detector for detecting the absence and/or the presence of the sanitizing agent at this location in the conduit.

The output of the liquid sensor is connected through appropriate electronic logic circuitry, including a timer, to a suitable indicator (such as an alarm) for indicating proper or improper delivery of the sanitizing agent. Then, during a delivery period for the sanitizing agent, the electronic circuitry is activated, and the timer begins timing for a predetermined time delay period. In the preferred embodiment, a period of $3\frac{1}{2}$ seconds has been found suitable. During this initial delay period, the indicator indicates that delivery is proper (for example, the alarm is not sounded). If during this delay period the liquid sensor first detects no sanitizer at the probe location in the conduit, and subsequently detects that sanitizer has arrived at that location, then proper delivery is indicated at the end of the time period (i.e., the alarm remains silent). Any other condition within the initial time delay period, such as failure of the sanitizing agent to arrive at the probes by the end of the period, or initial presence of the sanitizing agent before the cycle starts (when the sanitizer supply tubing is pinched), will be interpreted by the logic circuit as a delivery failure, and improper delivery will be indicated at the end of the period. Such an indication can be provided by a loud alarm and a suitable warning lamp. It might also be desirable to disable further operation of the warewasher until the cause for the alarm is discovered. This could be done by automatically turning the warewasher off. However, satisfactorily disabling the warewasher would preferably involve more operational steps than simply turning it off, and more sophisticated procedures of that type are not disclosed in the present invention.

Preferably, therefore, during normal operation the delivery period for the sanitizing agent starts with the sanitizing agent conduit empty. When the air powered venturi aspirator is actuated, the sanitizing agent is drawn up through the conduit, and when it reaches the aspirator it is injected into the rinse system. The control system for the warewasher is programmed to operate the aspirator for a sufficient time to draw the sanitizing agent through the conduit and deliver the proper quantity to the rinse system. The aspirator is then turned off, and gravity empties the agent in the conduit back into the storage bottle at the bottom of the warewasher. In the preferred embodiment, the aspirator is operated for approximately 17 seconds. It takes approximately $2\frac{1}{2}$ seconds for the sanitizing agent to reach the aspirator, and during the remaining $14\frac{1}{2}$ seconds the sanitizing agent is injected into the rinse system.

Essentially, therefore, the present invention, by testing for the absence and then the presence of the sanitizing agent at a location spatially separated from the sanitizing agent supply and in a particular temporal sequence, is actually able to test for proper flow, and hence proper delivery, of the sanitizing agent. Of course, it can be seen that the test is not absolute. However, the warewasher on which the present invention is used, as previously indicated, has a high degree of mechanical reliability. Within acceptable limits, therefore, it can be comfortably assumed that if it is working at all, it is working correctly. Thus, the present invention can provide an indication of proper delivery simply by looking for the absence of the sanitizing agent at the outlet end of the conduit on the top of the warewasher, followed by the presence thereof, within a suitable delay period for pulling the agent through the conduit (e.g. $3\frac{1}{2}$ seconds).

More specifically, the present invention employs a flip-flop circuit which starts each cycle in a state which indicates failure (i.e., improper delivery). However, the timer is simultaneously energized, and it inhibits the actual failure indication during the initial $3\frac{1}{2}$ second period. The liquid sensor and associated circuitry provides no output except when there is a change in the sanitizing agent at the probe location. That is, as long as sanitizing is present at the probes there is no output; as long as sanitizing agent is absent there is no output. When the condition changes from detecting no sanitizing agent to detecting the presence of the agent, a negative pulse is generated which is applied to the flip-flop circuit, causing it to change to an "okay" condition. A change in the liquid detector from liquid present to liquid absent will produce a small positive pulse which does not affect the flip-flop. At the end of the $3\frac{1}{2}$ second time period, the timer then allows the flip-flop to control the delivery indicator. If the flip-flop has not been triggered by a negative pulse, the alarm will be actuated. If the flip-flop has been properly triggered, the alarm will not be actuated. Therefore, the preferred embodiment actually requires the agent to go from an absent state to a present state at the probe location during the initial time delay period. If this has not occurred by the end of the period, the alarm will alert the machine operator that a possible fault or failure has occurred. In this sense the alarm itself is a delivery indicator having two switchable states. The first state is a quiet state indicating proper delivery of the sanitizing agent. The second state is the actuated state in which the alarm sounds to indicate improper delivery.

It is therefore an object of the present invention to provide a sanitizer alert system and method for use in warewashers for monitoring and verifying delivery of a chemical sanitizing agent to the rinse system of the warewasher during each of successive delivery periods; a sanitizer alert system which provides an effective indication of delivery of the agent without the complications and expense of true flow rate indicators; which can provide such an indication through the use of an inexpensive and uncomplicated proximity detector which monitors the sanitizing agent in the sanitizing agent delivery system and tests the condition thereof at different times during a delivery period; which can provide such an indication by preferably testing first for the absence followed by the presence of the sanitizing agent at a location in the sanitizing agent delivery system spaced from the source of the agent, within a particular time period; and to provide the above objects and purposes in an inexpensive, uncomplicated, durable and reliable configuration readily suited for use in energy saving, chemically sanitizing warewashing machines.

Other objects and advantages of the invention will be apparent from the following description, the accompanying drawings and the appended claims.

DESCRIPTION OF THE PREFERRED EMBODIMENT

Figure 1:
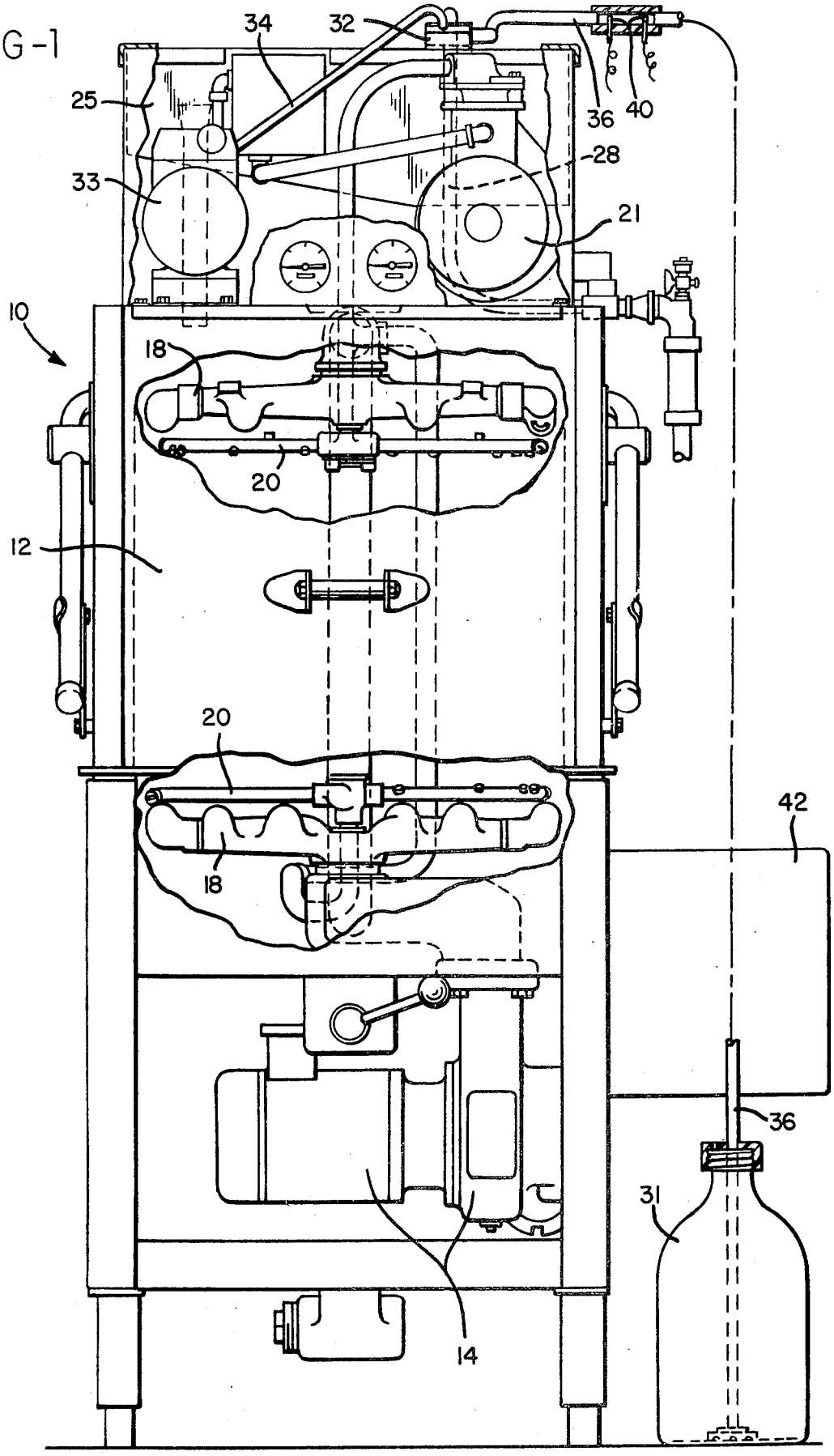
FIG. 1 illustrates a warewasher incorporating the sanitizer alert system of the present invention.

FIG. 1 illustrates a warewashing machine 10 such as more fully described in U.S. application Ser. No. 835,197, filed Sept. 21, 1977, reference being made thereto for a more detailed description. Briefly, warewasher 10 includes a chamber 12 in which the food ware items are placed for washing and rinsing. During a wash cycle a conventional recirculating pump and motor 14 recirculate wash fluid through wash arms 18 for spraying onto the food ware items within chamber 12.

A rinse cycle follows the wash cycle. In some machines, such as shown in U.S. Pat. No. 3,903,909, the rinse solution is supplied and recirculated through the same pump and spray arms which recirculate the wash water. In warewasher 10, however, the rinse solution is sprayed through separate, dedicated rinse arms 20. A rinse pump and motor 21 pump the rinse solution to arms 20 from a rinse solution preparation and holding tank 25.

The rinse solution is prepared in holding tank 25 by providing the proper quantity of water through a water inlet pipe 28 and the proper quantity of sanitizing agent through a sanitizing agent delivery system. The latter includes a bottle 31 of sanitizing agent (preferably a 5.2% solution of NaOCl), an air powered venturi aspirator 32, an air pump 33 connected by an air line 34 to aspirator 32, and a sanitizer conduit 36 which connects bottle 31 to aspirator 32. When air pump 33 is actuated, aspirator 32 draws the sanitizing agent from bottle 31 through conduit 36 and injects the sanitizing agent into the holding tank 25 (and hence into the warewasher rinse system). When air pump 33 is turned off, the sanitizing agent in conduit 36 is easily returned by gravity to bottle 31, since the outlet end of the aspirator is open to the atmosphere, so that no vacuum develops within conduit 36.

Figure 2:
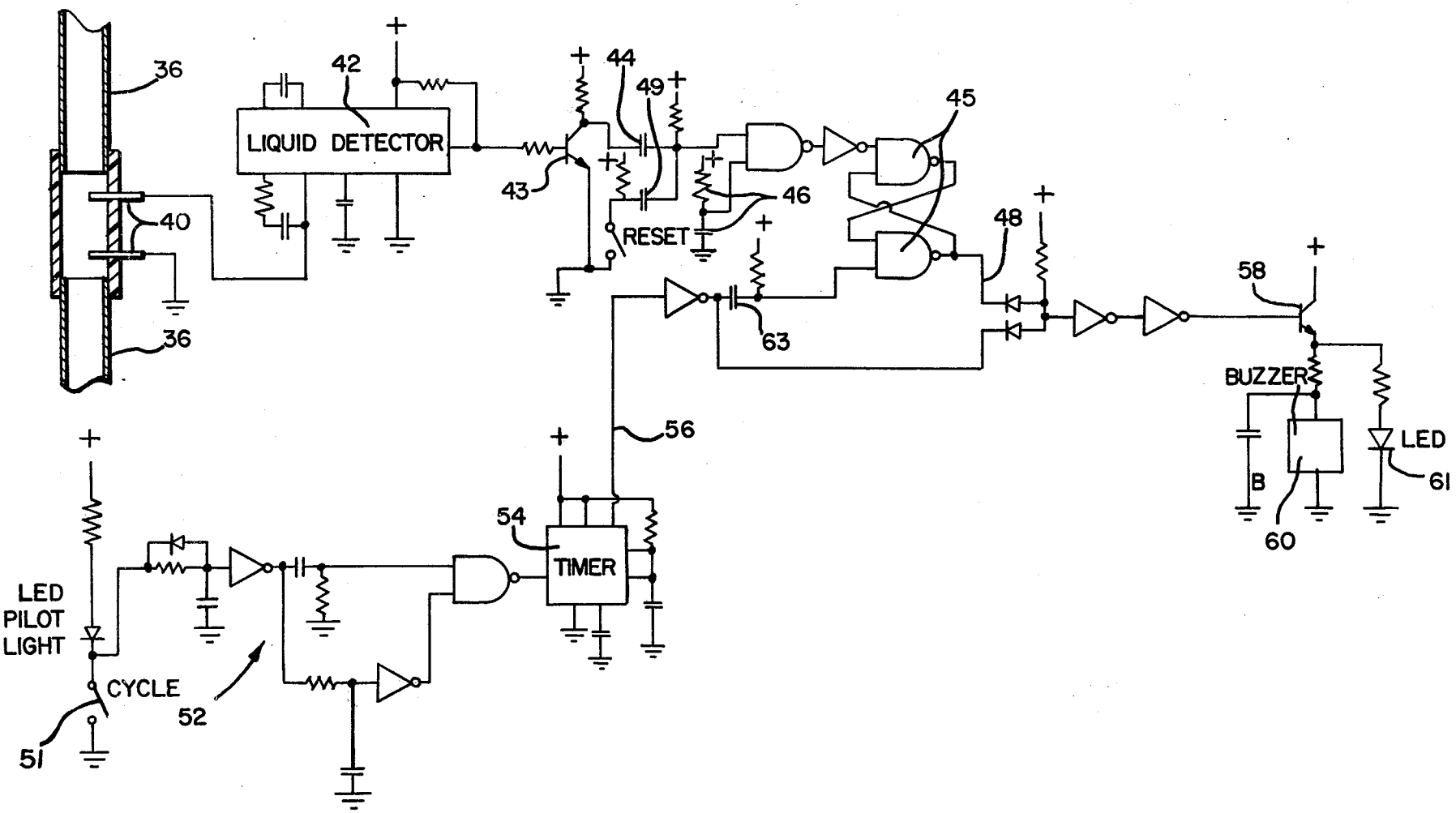
FIG. 2 is a schematic diagram of a circuit for carrying the present invention into effect.

Located near the aspirator 32 and in the conduit 36 is a pair of titanium probes 40 (FIGS. 1 and 2). One of the probes is grounded, and the other is connected to a circuit suitable for detecting completion of the electrical circuit between the probes. A number of liquid sensing circuits are suitable for this purpose, and in the preferred embodiment illustrated in FIG. 2, liquid sensing circuit 42 is an LM 1830 manufactured by National Semiconductor, 2900 Semiconductor Road, Santa Clara, California 95051. This is connected to a transistor 43 so that when the circuit between the probes 40 is open, the collector of transistor 43 is at a high potential, and when the sanitizing agent completes the circuit between the probes 40, the collector of transistor 43 is switched to low (near ground) potential. The collector of transistor 43 is coupled through a capacitor 44 to a flip-flop circuit 45, along with an RC power-up reset circuit 46, so that when the logic circuit is first energized the output of the flip-flop at line 48 is always low. The RC power-up reset circuit has a time constant of approximately 1/10 second. Thereafter, a negative pulse through capacitor 44 will change the flip-flop output at 48 to low. Thus, if circuit 42 initially detects no sanitizing agent at probes 40 and subsequently detects the agent, it will switch the collector of transistor 43 from high to low, generating a negative pulse through capacitor 44. Any other condition will not generate such a pulse. That is, continuous presence of the sanitizer or continuous absence will generate no pulse, presence followed by absence will produce a small positive pulse, but no negative pulse. A manual reset switch and circuit are also provided and coupled through a capacitor 49 so that the machine operator can manually apply a negative pulse to the flip-flop 45.

When the flip-flop output line 48 is high, this indicates a failure condition. However, at the start of the delivery cycle the cycle switch 51 is closed, applying a ground potential through a filter network 52 to a delay timer 54 (such as an NE 555). This causes the output line 56 of the timer to go high for the predetermined time period of the timer. Line 56, in turn, is coupled through suitable gates (or diodes) to block the output from the flip-flop output line 48. At the end of the time interval (e.g., 3½ seconds), output line 56 goes low. At that time, if the flip-flop output line 48 is still high, it will switch a driver transistor 58 to conduction. This will energize a buzzer 60 and a red LED warning light 61. If flip-flop output line 48 at this time is low (due to a negative pulse having been applied to flip-flop 45 during the 3½ second inhibit interval of timer 54), then transistor 58 will not conduct and the buzzer 60 and LED 61 will remain off.

At the start of the next delivery period, timer 54 is reset, causing line 56 to go high again. This in turn sends a negative pulse through capacitor 63 which sets the flip-flop to the "fail" state (switching output line 48 to high). But simultaneously the signal on line 48 from the flip-flop is blocked, as previously discussed, so that the driver transistor 58 remains off at least until the end of the 3½ second time delay interval.

Noise filter network 52 could be omitted and the signal from cycle switch 51 could be applied directly to timer 54. Network 52 is useful, however, since warewasher 10 includes several motors which produce noise (transient spikes). Network 52 essentially locks the input to timer 54 in the high state as long as cycle switch 51 is closed, so that electrical pulses will not inadvertently reset the timer during this portion of the machine cycle.

As may be seen, therefore, the present invention provides numerous advantages. When used in conjunction with a mechanically reliable chemically sanitizing warewashing machine, the present invention provides an inexpensive, uncomplicated, yet reliable and efficient indicator for monitoring and verifying delivery of a chemical sanitizing agent to the rinse system of the warewasher. When the sanitizing agent is electrically conductive, an inexpensive conductivity detector may be used for testing for presence or absence of the sanitizing agent at the proper location in the conduit 36. For nonconductive fluids, any other suitable proximity detector could be used. Since it is known that for a given installation the proper flow rate will require a certain time for the agent to move through conduit 36 from bottle 31 to probes 40, it is possible through multiple testing at separate time periods to get a very reliable indication of proper flow, and hence proper delivery of the sanitizing agent. This can be done efficiently without the expense or complication of actual in line flow detectors.

The use of a relatively long conduit 36 is not necessary, but gives a better indication and provides a wider tolerance in the timing interval of timer 54. That is, if the probes 40 were located close to bottle 31, the interval for timer 54 would have to be very short. Otherwise, a partially blocked line might pass sufficient sanitizing agent to complete the circuit in probes 40, but prevent the agent from ever reaching the outlet of the aspirator 32. Thus, regardless of whether conduit 36 is long or short, or aspirator 32 is near or far from bottle 31, proper testing would be more difficult if probes 40 were located near bottle 31. Therefore, the probes in the preferred embodiment are located close to aspirator 32 on the end of conduit 36 farthest from bottle 31. Bottle 31 is at the end of the conduit at the bottom of warewasher 10, while aspirator 32 and probes 40 are on the opposite end at the top. Therefore, if probes 40 satisfy the conductivity testing requirements specified above, this provides a reliable indication that the sanitizing agent is reaching and being delivered by the aspirator 32 at the proper rate.

By locating the aspirator 32 and probes 40 on top and the bottle 31 at the bottom, the conduit 36 automatically drains the sanitizing agent back into bottle 31 at the end of each delivery period. In this way, the liquid portions of the system are automatically reset so that the proper sequential tests can be made at the beginning of the next delivery period.

An additional advantage is provided by the substantial vertical separation of the aspirator and probes from the bottle 31. This minimizes the effects of changes in the level of sanitizing agent within the bottle. That is, the lifting force required, and hence the flow rate of the sanitizing agent, are determined by the distance the agent must be lifted above the level of the top of the fluid in bottle 31. As the bottle drains, the height through which the fluid must be lifted will increase, and the flow rate will therefore decrease. In the present invention, this change in height is but a small percentage of the total height through which the fluid is lifted, so that for practical purposes the flow rate is unaffected by changes in the level of the agent in bottle 31, as it is emptied in use.

The present invention thus provides consistent and reliable monitoring and verification of proper delivery of the sanitizing agent, and alerts the machine operator upon a delivery failure. It is uncomplicated and inexpensive in design, yet highly effective in operation. If the sanitizing agent bottle is empty, delivery will not be confirmed, and the alarm will be sounded. If the delivery line is blocked so that agent is not present at probes 40, the alarm will be sounded. If the delivery line is blocked so that agent is present but cannot drain back to the bottle, and hence likewise cannot be properly delivered to the rinse system, the alarm will be sounded. In fact, when the detector is a conductivity detector (as shown in the preferred embodiment), the system will even indicate a failure if the machine operator attempts to fool it by filling bottle 41 with ordinary water. Ordinary water is not nearly as conductive as NaOCl, and the liquid sensing circuit 42 will not accept it even though it may reach probes 40.

While the method herein described, and the form of apparatus for carrying this method into effect, constitute preferred embodiments of this invention, it is to be understood that the invention is not limited to this precise method and form of apparatus, and that changes may be made therein without departing from the scope of the invention.

What is claimed is:

1. A sanitizer alert system in combination with a warewasher such as a dishwashing machine, having wash and rinse systems for cleaning food ware items placed therein, a source of chemical sanitizing agent, a conduit having an outlet end connecting the source of chemical sanitizing agent to an outlet end in the warewasher rinse system, means providing delivery periods for the chemical sanitizing agent, and means actuated during each of the delivery periods for moving the sanitizing agent through the conduit from the inlet end thereof to the outlet end to deliver sanitizing agent to the warewasher rinse system, the sanitizer alert system monitoring and verifying delivery of the chemical sanitizing agent to the rinse system of the warewasher during each of successive delivery periods, and comprising:

(a) a delivery indicator having at least two switchable states including a first state for indicating proper delivery of the sanitizing agent and a second state for indicating improper delivery, (b) means for activating said delivery indicator during each of the delivery periods, (c) detecting means for detecting the absence and the presence of the sanitizing agent at a predetermined location in the conduit, (d) means connected to said detecting means for switching said delivery indicator to said second state if the presence of sanitizing agent is detected at said predetermined conduit location at the beginning of a delivery period, and (e) means connected to said detecting means for switching said delivery indicator to said second state at the end of a predetermined time period upon detecting the continuing absence of sanitizing agent at said predetermined conduit location during said predetermined time period.

2. The device of claim 1 further comprising reset means for switching said delivery indicator to said first state.

3. The device of claim 1 wherein said detecting means is located closer to the outlet end than the inlet end of the conduit.

4. The device of claim 1 wherein said delivery indicator includes an alarm which is silent in said first state and actuated in said second state.

5. The device of claim 1 wherein the chemical sanitizing agent source is located near the bottom of the warewasher and the outlet end of the conduit is located near the top of the warewasher.

6. The device of claim 5 further comprising means for draining the sanitizing agent in the conduit back into the source thereof at the end of each delivery period.

7. A sanitizer alert system in combination with a warewasher such as a dishwashing machine, having wash and rinse systems for cleaning food ware items placed therein, a source of chemical sanitizing agent at the bottom of the warewasher, a conduit having an inlet end connecting the source of chemical sanitizing agent to an outlet end at the top of the warewasher in the warewasher rinse system, means providing delivery periods for the chemical sanitizing agent, and an air driven aspirator at the outlet end of the conduit, the aspirator being actuated during each of the delivery periods for moving the sanitizing agent through the conduit from the inlet end thereof to the outlet end to deliver sanitizing agent to the warewasher rinse system, the sanitizer alert system monitoring and verifying delivery of the chemical sanitizing agent to the rinse system of the warewasher during each of successive delivery periods, and comprising:

(a) a delivery indicator having at least two switchable states including a first state for indicating proper delivery of the sanitizing agent and a second state for indicating improper delivery, (b) reset means for switching said delivery indicator to said first state, (c) means for activating said delivery indicator during each of the delivery periods, (d) detecting means substantially adjacent the aspirator for detecting the absence and the presence of the sanitizing agent in the conduit prior to entering the aspirator, (e) means connected to said detecting means for switching said delivery indicator to said second state if the presence of sanitizing agent is detected at said predetermined conduit location at the beginning of a delivery period, (f) means connected to said detecting means for switching said delivery indicator to said second state at the end of a predetermined time period following the start of the delivery period upon detecting the continuing absence of sanitizing agent at said predetermined conduit location during said predetermined time period, and (g) means for draining the sanitizing agent in the conduit back into the source thereof at the end of each delivery period.

8. The device of claim 7 wherein said switching means further comprises:

(a) means for holding said delivery indicator in said first state during said predetermined time period, (b) means connected to said detecting means for registering a change from detecting the absence to detecting the presence of the sanitizing agent, and (c) means for placing said delivery indicator in said second state after said predetermined time period if said change has not been registered, and in said first state if said change has been registered.

* * * * *